US006013888A

United States Patent [19]

Thuries

[11] Patent Number: 6,013,888

[45] Date of Patent: Jan. 11, 2000

[54] GENERATOR CIRCUIT BREAKER HAVING A SINGLE MECHANICAL CONTROL MECHANISM

[75] Inventor: Edmond Thuries, Meyzieu, France

[73] Assignee: GEC Alsthom T & D SA, Paris, France

[21] Appl. No.: 09/181,996

[22] Filed: Oct. 29, 1998

[30] Foreign Application Priority Data

Oct. 30, 1997 [FR] France ..... 97 13627

[51] Int. Cl.[7] ..... H01H 33/12; H01H 33/66; H01H 9/38

[52] U.S. Cl. ..... 218/14; 218/78; 218/140; 218/154

[58] Field of Search ..... 218/7, 12–13, 218/14, 43, 45, 48–50, 67, 74, 78, 118, 120, 140, 143, 154

[56] References Cited

U.S. PATENT DOCUMENTS 3,671,696 6/1972 Brunner .
4,484,047 11/1984 Olsen et al. ..... 200/148 R
5,841,614 11/1998 Perret ..... 361/14

FOREIGN PATENT DOCUMENTS 0 092 205 A2 10/1983 European Pat. Off. .
0 177 951 A2 4/1986 European Pat. Off. .

*Primary Examiner*—Lincoln Donovan
*Attorney, Agent, or Firm*—Sughrue, Mion, Zinn, Macpeak & Seas, PLLC

[57] ABSTRACT

A circuit breaker comprising a first permanent current contact and a first arcing contact that are fixed, a second permanent current contact and a second arcing contact that are movable in a longitudinal direction to be connected with or separated from the fixed contacts, and a mechanism for displacing the moving contacts in the longitudinal direction in such a manner so as to separate the permanent current contacts before separating the arcing contacts. The mechanism includes a shaft movable in the longitudinal direction and secured to the moving permanent current contact, and a crank piece having two limbs forming an L-shape and rotatable about an axis that is fixed relative to the longitudinal direction and that extends perpendicularly to the direction, one limb of the crank piece being connected to the moving arcing contact, and its other limb being connected to the shaft.

8 Claims, 1 Drawing Sheet

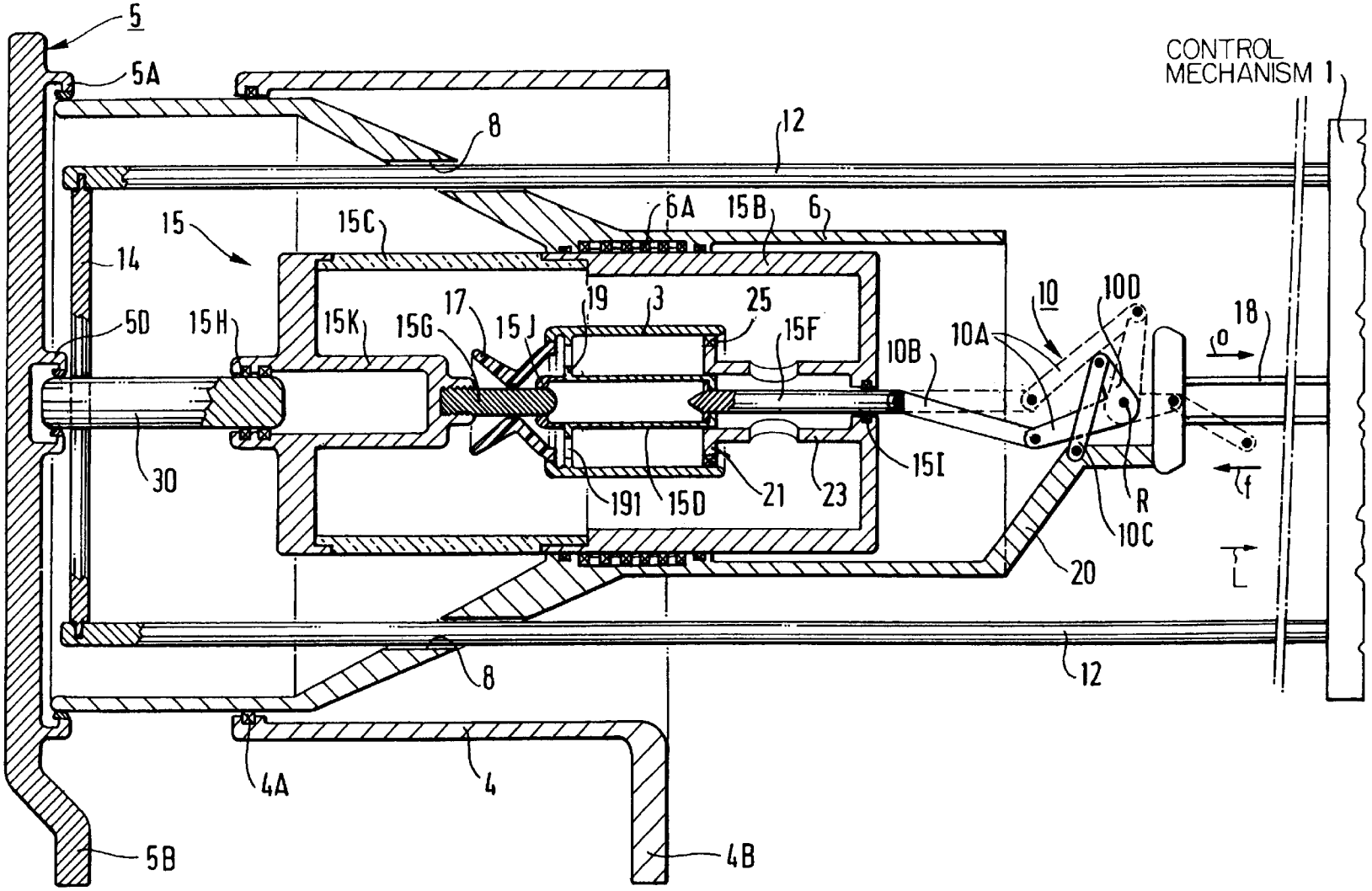
CONTROL MECHANISM 1
18
10D
R
10C
10
10A
10B
15I
20
12
6
15B
6A
3
19
15F
25
23
21
15D
191
15J
17
15G
15K
15H
15
14
50
30
8
15C
4B
4
4A
5
5A
5B

GENERATOR CIRCUIT BREAKER HAVING A SINGLE MECHANICAL CONTROL MECHANISM

The present invention relates to a generator circuit breaker comprising a first permanent current contact and a first arcing contact that are fixed, a second permanent current contact and a second arcing contact that are movable in a longitudinal direction to be connected with or separated from the fixed contacts, and means for displacing the moving contacts in the longitudinal direction in such a manner as to separate the permanent current contacts before separating the arcing contacts.

BACKGROUND OF THE INVENTION

Such a circuit breaker is commonly placed between a generator of an electricity generating station and a transformer connected to a power line, and is known from Patent Application FR 89 13279. In that known circuit breaker, the moving contacts are displaced in the longitudinal direction by pneumatic actuators which are provided with electrically-controlled valves controlled by sophisticated electronic control means to synchronize arcing contact opening and closing relative to permanent current contact opening and closing.

SUMMARY OF THE INVENTION

An object of the invention is to provide a generator circuit breaker in which the moving permanent current contact and the moving arcing contact are displaced by a a mechanism that is simpler.

To this end, the invention provides a generator circuit breaker comprising a first permanent current contact and a first arcing contact that are fixed, a second permanent current contact and a second arcing contact that are movable in a longitudinal direction to be connected with or separated from the fixed contacts, and means for displacing the moving contacts in the longitudinal direction in such a manner as to separate the permanent current contacts before separating the arcing contacts, wherein the means comprise a shaft movable in the longitudinal direction and secured to the moving permanent current contact, and a crank piece having two limbs forming an L-shape and rotatable about an axis that is fixed relative to the longitudinal direction and that extends perpendicularly to said direction, one limb of the crank piece being connected to the moving arcing contact via a first link, and its other limb being connected to the shaft via a second link.

In the invention, the moving shaft displaces the moving permanent current contact, and, via the L-shaped piece, displaces the moving arcing contact. A single mechanical control mechanism for controlling the moving shaft suffices to displace the moving contacts for the purposes of opening and closing the circuit breaker.

BRIEF DESCRIPTION OF THE DRAWING

Other characteristics and advantages of the invention appear on reading the following description given with reference to the sole FIGURE which is a very diagrammatic section view of a circuit breaker of the invention.

DETAILED DESCRIPTION OF THE PREFERRED EMBODIMENTS

As shown on the left of the FIGURE, the circuit-breaker includes a fixed first permanent current contact that is fixed relative to a support (not shown), and a moving second permanent current contact 6 that is movable in a longitudinal direction L and that has a cup-shaped end insertable into a ring of contact fingers 5A carried by the fixed permanent current contact 5. The permanent current contact 5 is provided with a tab 5B designed to be connected to a voltage step-up transformer. The moving permanent current contact 6 is mounted to slide in a metal guide tube 4 designed to be connected via a tab 4B to a generator. Clearly, the transformer and the generator can be connected in either order to the connection tabs 4B and 5B. A sliding contact 4A of the tube 4 enables electrical current to flow between the guide tube 4 and the moving permanent current contact 6.

The circuit breaker includes a gastight tubular interrupting chamber 15 which extends parallel to the longitudinal direction L and which is held fixed in the casing of the circuit-breaker by elements that are known are which are not shown. A hollow second arcing contact 15D is mounted to move in the longitudinal direction L inside the interrupting chamber 15 via a rod 15F that projects from the interrupting chamber 15 through an opening provided with a sliding sealing gasket 15I. A first arcing contact 15G is mounted fixed inside the interrupting chamber 15. The moving arcing contact 15D slides on the fixed arcing contact via a ring of contact fingers 15J.

The interrupting chamber 15 is disposed inside the moving permanent current contact 6 which is tubular in shape, and which is provided with a sliding contact 6A via which it slides relative to the interrupting chamber 15. An insulating portion 15C prevents electrical current from flowing directly from the fixed arcing contact 15G to the moving permanent current contact 6.

The fixed permanent current contact 5 carries a ring of contact fingers 5D in which a disconnector rod 30 is insertable. The disconnector rod is movable in the longitudinal direction L and it slides relative to the interrupting chamber 15 via a sliding contact 15H providing an electrical connection between the disconnector rod 30 and the fixed arcing contact 15G.

The means of the invention for displacing the moving contacts comprise firstly a shaft 18 which is driven in translation in the longitudinal direction L by a conventional control mechanism 1, and which is secured to the moving permanent current contact 6 via a rigid rod 20, and secondly a crank piece 10 having two limbs substantially forming an L-shape and rotatable in a plane perpendicular to the longitudinal direction L about a fixed axis R extending through the intersection of the two limbs.

The longer limb 10A is connected to the rod 15F via a first link 10B. The shorter limb 10D is connected to the shaft 18 via a second link 10C. When the circuit breaker is closed, the long limb 10A and the link 10B are substantially parallel to the longitudinal direction L, whereas the short limb 10D and the link 10C are substantially perpendicular to the longitudinal direction L.

The sole FIGURE shows the circuit breaker in the closed position. During a first opening stage:

- the shaft 18 is displaced in the longitudinal direction L towards the right of the FIGURE, as indicated by the arrow o;
- the moving permanent current contact 6 is displaced by the shaft 18 in the longitudinal direction L so as to be separated from the fixed permanent current contact 5;
- the second link 10C is displaced angularly by the shaft 18 such that it causes almost no force to be exerted on the short limb 10D and, as a result, almost no rotation of the crank piece 10; and the first link 10B thus remains substantially parallel to the longitudinal direction L, thereby not causing any force to be exerted on the moving arcing contact 15D.

During this first opening stage, the permanent current contacts separate, while the arcing contacts remain connected together. The first opening stage ends once the moving permanent current contact 6 is separated from the fixed permanent current contact 5 by a distance that is long enough to withstand a transient voltage in the ambient medium of the circuit breaker, e.g. by about 100 millimeters (mm) when the ambient medium is atmospheric air.

During a second opening stage:

the moving permanent current contact 6, entrained by the shaft 18, continues and terminates its displacement;

the second link 10C moves away from its initial position perpendicular to the longitudinal direction L by being displaced to the right of the sole FIGURE, and it reaches a position in which it is almost parallel to the longitudinal direction L, thereby causing a force to be exerted on the short limb 10D, and, as a result, causing the crank piece 10 to rotate about the axis R until the long limb 10A reaches a position in which it is almost perpendicular to the longitudinal direction L; and the first link 10B moves away from its initial position substantially parallel to the longitudinal direction L, and it reaches a position in which it is almost perpendicular to the longitudinal direction L, thereby causing the moving arcing contact 15D to be displaced in the longitudinal direction L.

The shorter the limb 10D and the longer the limb 10A, the faster the arcing contacts separate during this second opening stage.

The crank piece 10 delays separation of the arcing contacts relative to separation of the permanent current contacts until the permanent current contacts have separated from each other by the distance necessary to withstand the transient voltage in the ambient medium of the circuit breaker.

On closing, the shaft 18 is displaced in the opposite direction, as indicated by the arrow f in the sole FIGURE, and the above-described opening sequence takes place in reverse chronological order.

The kinematics of the part 10 make it possible for the arcing contacts to connect before the moving permanent current contact 6 is at a distance from the fixed permanent current contact 5 that is shorter than the distance necessary to withstand the transient voltage in the ambient medium of the circuit breaker.

In the circuit breaker of the invention, the interrupting chamber 15 is a vacuum "bottle", or a "bottle" filled with a dielectric gas of the sulfur hexafluoride $SF_6$ type. In the latter case, the moving arcing contact 15D is rigidly mounted via a front ring 19 in a first tube 3 forming a compression chamber. The rod 15F slides by means of the sliding sealing gasket 15I in a second tube 23 integral with the interrupting chamber 15 and that carries a rear ring 21 forming the end wall of the compression chamber. The tube 3 slides relative to the rear ring 21 by means of a sliding contact 25 which enables current to flow between the moving arcing contact 15D and the moving permanent current contact 6, via the sliding contacts 6A and via a metal portion 15B of the interrupting chamber 15.

On circuit breaker opening, by moving towards the right of the sole FIGURE as indicated by arrow o, the moving arcing contact 15D compresses the dielectric gas that is contained in the interrupting chamber and that escapes via openings 191 in the front ring 19 while being directed by a blast nozzle 17 onto the fixed arcing contact 15G to extinguish a short-circuit electric arc.

After circuit-breaker opening, two rigid rods 12 that are mounted to move in the longitudinal direction L are driven by the mechanical control mechanism 1, and separate the disconnector rod 30 from the fixed permanent current contact 5 via a transverse rigid rod 14 secured to the disconnector rod and by inserting the disconnector rod into a recess 15K in the interrupting chamber 15. All action on the circuit breaker is thus performed with maximum safety from the risk of short-circuiting.

On circuit breaker closing, the rigid rods 12 are driven to connect the disconnector rod 30 to the fixed permanent current contact 5, with the arcing contacts and the permanent current contacts still separated.

What is claimed is:

1. A generator circuit breaker comprising:

a first permanent current contact and a first arcing contact that are fixed, and a second permanent current contact and a second arcing contact that are movable in a longitudinal direction to be either one of connected with and separated from the first permanent current contact and the first arcing contact, respectively, the second permanent current contact and the second arcing contact further being movable relative to each other in said longitudinal direction, and means for displacing, in two stages, the moving second permanent current contact and the second arcing contact in the longitudinal direction in such a manner so as to separate the first permanent current contact and second permanent current contact in a first of said two stages, before separating the first arcing contact and second arcing contact in a second of said two stage, wherein the displacing means comprises:

a shaft movable in the longitudinal direction and secured to the moving second permanent current contact, and a crank piece having two limbs forming an L-shape and rotatable about an axis at the intersection of its two limbs, which axis is fixed relative to the longitudinal direction and extends perpendicularly to said direction, one limb of the crank piece being connected to the moving second arcing contact via a first link, and the other limb of the crank piece being connected to the shaft via a second link, the kinematics of said crank piece and of the first link and second link being such that, on circuit breaker opening in a first stare, a first stroke of the shaft in said longitudinal direction causes the first permanent current contact and second permanent current contact to separate without said crank piece being displaced angularly about its axis, and in a second stage, a subsequent stroke of the shaft in said direction causes said crank piece to be displaced angularly about its axis, thereby acting, via the linkage to cause the first arcing contact and second arcing contact to separate with a delay relative to separation of the first permanent current contact and second permanent current contact.

2. A circuit breaker according to claim 1, in which, when the circuit-breaker is opened, the first link and that limb of said crank piece which is connected to said first link extend substantially parallel to said longitudinal direction, whereas the second link and the limb that is connected to said second link extend substantially perpendicularly to said longitudinal direction.

3. A circuit breaker according to claim 2, in which that limb of the crank piece which is connected to the second link is shorter than that limb of the crank piece which is connected to the first link.

4. A circuit breaker according to claim 1, in which the first arcing contact and second arcing contact are disposed inside a gas-tight interrupting chamber.

5. A circuit breaker according to claim 4, in which the interrupting chamber contains a dielectric gas under pressure.

6. A circuit breaker according to claim 5, in which the moving second arcing contact is mounted inside a compression chamber for compressing the dielectric gas.

7. A circuit breaker according to claim 4, in which the interrupting chamber is a vacuum bottle.

8. A circuit breaker according to claim 1, in which the fixed first arcing contact is connected to the fixed first permanent current contact via a disconnector rod that is movable in the longitudinal direction.

* * * * *